US006389779B1

(12) United States Patent
Brunnhofer

(10) Patent No.: US 6,389,779 B1
(45) Date of Patent: May 21, 2002

(54) PROFILED SPACER FOR AN INSULATION-PLATE UNIT

(75) Inventor: Erwin Brunnhofer, Fuldabrück (DE)

(73) Assignee: Technoform Caprano + Brunnhofer OHG, Fuldabruck (DE)

( * ) Notice: Subject to any disclaimer, the term of this patent is extended or adjusted under 35 U.S.C. 154(b) by 0 days.

(21) Appl. No.: 09/582,521

(22) PCT Filed: Jan. 21, 1999

(86) PCT No.: PCT/DE99/00188

§ 371 Date: Jun. 26, 2000

§ 102(e) Date: Jun. 26, 2000

(87) PCT Pub. No.: WO99/41481

PCT Pub. Date: Aug. 19, 1999

(30) Foreign Application Priority Data

Feb. 11, 1998 (DE) ..... 198 05 348

(51) Int. Cl.[7] ..... E04C 2/54
(52) U.S. Cl. ..... 52/786.13; 52/172; 428/34
(58) Field of Search ..... 52/786.13, 172; 428/34, 35.8

(56) References Cited

U.S. PATENT DOCUMENTS 5,079,054 A * 1/1992 Davies ..... 428/35.8
5,460,862 A * 10/1995 Roller ..... 428/35.7
5,514,432 A * 5/1996 Lisec ..... 428/35.8
5,962,090 A * 10/1999 Trautz ..... 428/34

FOREIGN PATENT DOCUMENTS

| | | |
|---|---|---|
| DE | 92 14 799.2 | 2/1993 |
| DE | 93 03 795.3 | 8/1994 |
| EP | 0 113 209 | 7/1984 |
| GB | 2 162 228 | 1/1986 |

* cited by examiner

*Primary Examiner*—Carl D. Friedman
*Assistant Examiner*—N. Slack
(74) *Attorney, Agent, or Firm*—Herbert Dubno

(57) ABSTRACT

The invention relates to a spacer profile of an elastically-plastically deformable material with low heat conductivity for a spacer frame to be mounted in the marginal area of at least two spaced-apart panes by forming an intermediate pane space, whereby the spacer profile comprises a chamber which has in one of its walls at least one elastically-plastically deformable reinforcement element extending along the chamber, and whereby the spacer profile has a diffusion-proof layer extending substantially over its entire width and length. In order to produce the profile through cold flexion, the lateral walls of the chamber are each provided with at least one reinforcement element.

16 Claims, 3 Drawing Sheets

PROFILED SPACER FOR AN INSULATION-PLATE UNIT

CROSS REFERENCE TO RELATED APPLICATIONS

This application is a national stage of PCT/DE99/00188 filed Jan. 21, 1999 and based in turn upon German national application 198 05 348.7 filed Feb. 11, 1998 under the International Convention.

FIELD OF THE INVENTION

The present invention relates to a profiled spacer for a spacing frame and, more particularly, to a spacer made of a material capable of elastic-plastic deformation with low thermal conductivity, to be mounted in the border region of at least two spaced-apart plates, particularly transparent panes for insulated window units, and capable of forming an intermediate space between the panes, whereby the profiled spacer comprises a chamber which in its walls has a plastically deformable reinforcement element extending in a longitudinal direction of the profile.

BACKGROUND OF THE INVENTION

Within the framework of the invention, elastically-plastically deformable materials are materials in which elastic restoring forces act after the bending process, as is typically the case in plastic materials, whereby a part of the bending takes place with a plastic, non-reversible deformation.

Plastically deformable materials are materials wherein practically there is no action of any elastic restoring forces after bending, as is typically the case in the bending metals beyond their yield limit.

Materials with poor thermal conductivity or heat-insulating materials comprise materials which, compared to metals, have a clearly diminished thermal conductivity, which means a thermal conducting reduced by at least a factor of 10. The thermal conductivity values are typically of the order of magnitude $\lambda \approx 5$ W/(m·K), and preferably smaller than 1 W/(m·K), and even more preferably smaller than 0.3 W/(m·K).

Within the framework of the invention, the plates of the insulation-plate unit are normally glass panes of inorganic or organic glass, although the invention is not limited to them. The panes can be coated or refined in any other way, in order to impart special functions to the insulating window unit, such as increased thermal insulation or sound insulation.

Spacer frames have the important task of keeping the panes of a window unit spaced apart, to insure the mechanical strength of the unit and to maintain the intermediate space between the panes free from external influences. Primarily in insulating window units with a high thermal insulating capability it can be seen that the heat conductivity characteristic of the marginal interconnection, and thereby of the profiled spacer which constitutes the spacer frame, needs spacial attention. A decrease of the thermal insulation in the border region of an insulating window unit meant to have a high thermal insulation capability because of the use of common metallic spacers has been proven many times.

For this reason, besides metallic profiled spacers, for quite some time profiled spacers of plastic material have also been used, in order to utilize the low thermal conductivity of such materials. However as a rule such materials are less resistant to diffusion than metals. Since the humidity in the surrounding air has to be prevented from penetrating into the intermediate pane space and the escape of filling gases, such as argon, krypton, xenon and sulfur hexafluoride which fill the intermediate pane space has to be kept within minimal limits, as a rule special measures have to be taken when plastic profiles are used. For this reason the DE-A 33 02 659 for instance proposes to provide a profiled spacer with a vapor barrier in the form of a metal foil or a metallized plastic foil applied over the plastic profile.

Plastic profiles have the further disadvantage that they can be bent only with difficulty or cannot be bent at all to form spacer frames made in one piece. Therefore plastic profiles are generally produced in straight bars cut to the sizes required by the respective window unit and interconnected by several corner connectors to form a spacer frame.

DE 93 03 795 U1 discloses reinforcement bodies extending in the longitudinal direction of the profile, which are embedded exclusively in the inner wall of the spacer profile facing the intermediate pane space. In this way the reinforcements are supposed to support the stability of the inner wall facing the intermediate pane space, which is endangered by UV-radiation and heat expansion. The bending behavior of the aforementioned profile is not discussed in this reference.

DE-U-92 14 799 and GB-A-2 162 228 disclose spacer profiles of the kind mentioned in the introduction with a single reinforcement element extending from an outer corner area of the profile over its outer wall into the other outer corner area and which obviously does not allow for the production of an one-piece spacer frame through cold flexion.

OBJECT OF THE INVENTION

It is the object of the present invention to provide a thermally insulating spacer profile which can produced on a large scale in a cost-efficient manner, from which it is possible to simply produce a spacer frame made in one piece. It should be possible to produce the profile through cold flexion, particularly with conventional, albeit slightly modified bending devices, and if necessary with a little heating, to make it bendable enough, without the occurrence of undesirable deformations.

SUMMARY OF THE INVENTION

This object is achieved with the spacer profile having a chamber and separating the window panes. The reinforcements are located at the corners of the chamber or only in the lateral walls. According to the invention the lateral walls of the chamber are each provided with at least one reinforcement element.

Since in the spacer profile of the invention the reinforcement elements are embedded in the lateral walls of the spacer profile made of materials with low thermal conductivity, or are arranged on their surface, therefore not creating any direct thermal contact between the panes, the thermal conductivity from one pane to the other through the spacer profile is influenced by the reinforcement elements very little. On the other hand, due to their plastic deformability, as well as to the arrangement in area of the lateral walls of the profile, they contribute considerably towards achieving the object of the invention.

Due to the arrangement of the reinforcement elements according to the invention, in the selection of the elastically-plastically deformable materials with poor heat conductivity, constituting the main component by volume of the profile, it is possible to use also materials whose plastic deformability is not of the first order, and even almost perfectly elastic materials, when these offer advantages from the point of view of heat insulation. On the other hand, the reinforcement element can be selected targeting their plastic deformability and their characteristics during the bending process, without subjecting their dimensions or their material to substantial limitation with regard to the level of their thermal conductivity.

For the bending process commercially available bending devices without significant modifications can be used.

The profile of the invention is designed as a hollow-chamber profile, whereby the chamber is normally filled with hygroscopic material and whereby water-vapor permeable areas, such as perforations, in the inner chamber wall facing the intermediate pane space make a vapor and humidity exchange possible between the intermediate pane space and the chamber. In this way the humidity content in the intermediate space between the panes is kept at a low level, in order to avoid condensation at low temperatures. Alternatively, the spacer profile can also have a U-shaped cross section open towards the intermediate pane space, when care is taken that the drying agent is firmly anchored in the chamber, e.g. through adhesion.

The cross section of the reinforcement elements can have various shapes. So for instance these elements can be in the form of wires, which makes simple and cost-effective production possible.

Further the reinforcement elements can be flat or corner profiles. This insures a high degree of shape stability, particularly in the cross section corner areas of the spacer profile. It is also possible to combine wires and flat or corner profiles in a spacer profile.

Generally the reinforcement elements are made of metal or of a metal alloy, preferably aluminum or an aluminum alloy. As a result a particularly high degree of plastic deformability of the spacer profile and a particularly low resilience after bending are insured.

The diameter of the wires is preferably smaller than 3 mm, particularly approximately 1 mm, while the flat or corner profiles have generally a thickness of less than 3 mm, preferably a thickness of less than 1 mm. With this wire diameter or thickness of the profile, a good plastic deformability at low material consumption and low weight of the spacer profile is insured.

The reinforcement elements are preferably arranged in cross section corner areas of the spacer profile. These areas, which are particularly stressed during the bending process through stretching or compression, are very sensitive and damage occurs during the bending process particularly in these areas in the case of conventional profiles. The reinforcement elements in these areas prevent the occurrence of such damage. If reinforcement elements in the form of wires or corner profiles are arranged at least in the areas of both ends of the two lateral walls, then the bending moment of resistance of the spacer profile is reduced in an advantageous manner, so that a particularly good cold flexion can be achieved.

In another preferred embodiment the flat or corner profiles extend substantially over the entire height of the side walls of the spacer profile. Because of the high bending moment of resistance resulting therefrom, the side walls have a particularly high stability, so that the occurrence of damaging deformation can be reliably avoided.

In another preferred embodiment, the cross sectional shape of the corner profiles provided in the cross section corner areas of the spacer profile correspond substantially to the cross section of these corner areas, for good protection of the spacer profile during the bending process and the general handling and high shape stability.

It is within the framework of the invention to provide reinforcement elements of different material inside the same profile. Also reinforcement elements of composite materials can be provided. The reinforcement elements can be made of different materials or have different thicknesses in their longitudinal direction or also over their cross section.

Thermoplastic materials with a thermal conductivity value $\lambda<0.3$ W/(m·K), e.g. polypropylene, polyethylene-terephthalate, polyamide or polycarbonate have proven to be well-suited heat-insulating materials for the spacer profile. The plastic material can contain the usual filler, additives, dyes, agents for UV protection, etc.

Preferably a diffusion-proof layer is provided, which extends substantially over the entire width and length of the spacer profile and is made of a material with a thermal conductivity value $\lambda<50$ W/(m·K). Metals, particularly tin plate or also stainless steel, have proven to be preferred materials for the diffusion-proof layer. Further the diffusion-proof layer can be made of plastic such as fluorine-containing polymers, polyvinylidene chloride or ethylvinyl acetate. The diffusion-proof layer can be applied through physical or chemical coating methods, such as for instance sputtering or plasma polymerization. Preferably it is materially bonded as foil with the material of the profile. Thereby the "material bonding" means the permanent bonding of the two components of the bond, for instance through lamination, optionally by means of a bonding agent, through embedding or similar techniques.

The diffusion-proof layer is preferably arranged also in the area of the side walls.

For cost reasons and for technological reasons, the diffusion-proof layer is preferably applied to the outside of the outer chamber wall and optionally to its side walls. However it can also be arranged on the inside or be embedded in the walls. As a result the bending process can be even further simplified, depending on the bending device, since this way a direct contact of the mechanically sensitive diffusion-proof layer with the force-applying elements of the bending device can be avoided. Besides this way a durable protection of the diffusion-proof layer can be insured.

The diffusion-proof layer can be additionally provided with a protective layer, in order to extensively avoid for instance aging processes or radiation influences, or also damage due to mechanical stress.

In a window unit according to the invention with a spacer profile like the one described above, the spacer profile is preferably cemented to the inside of the panes with a butylene sealing material based on polyisobutylene.

BRIEF DESCRIPTION OF THE DRAWING

In the following the invention is further explained with reference to the drawing. In the drawing.

| | |
|---|---|
|

-continued

Figure 3:
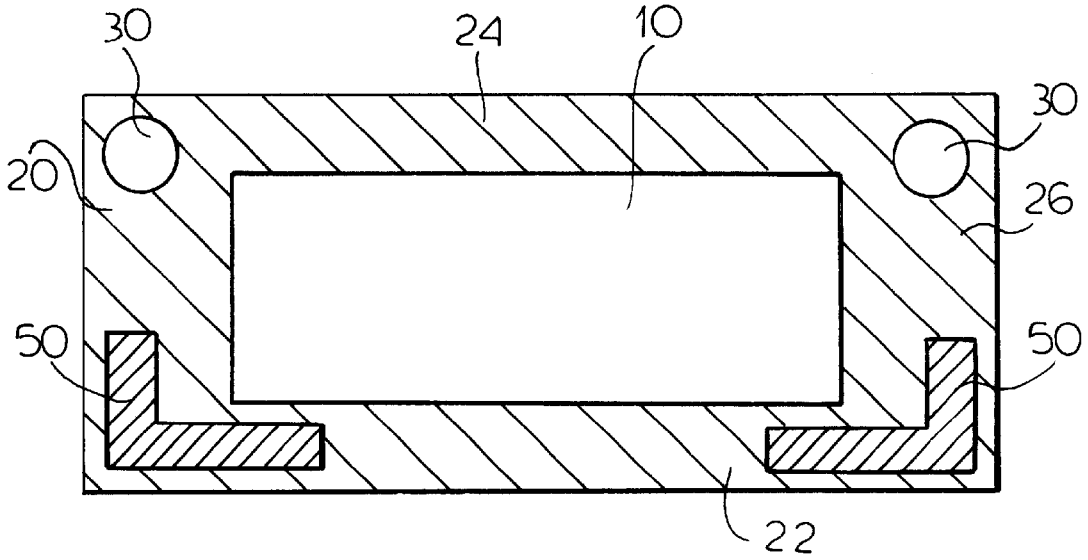
Figure 4:
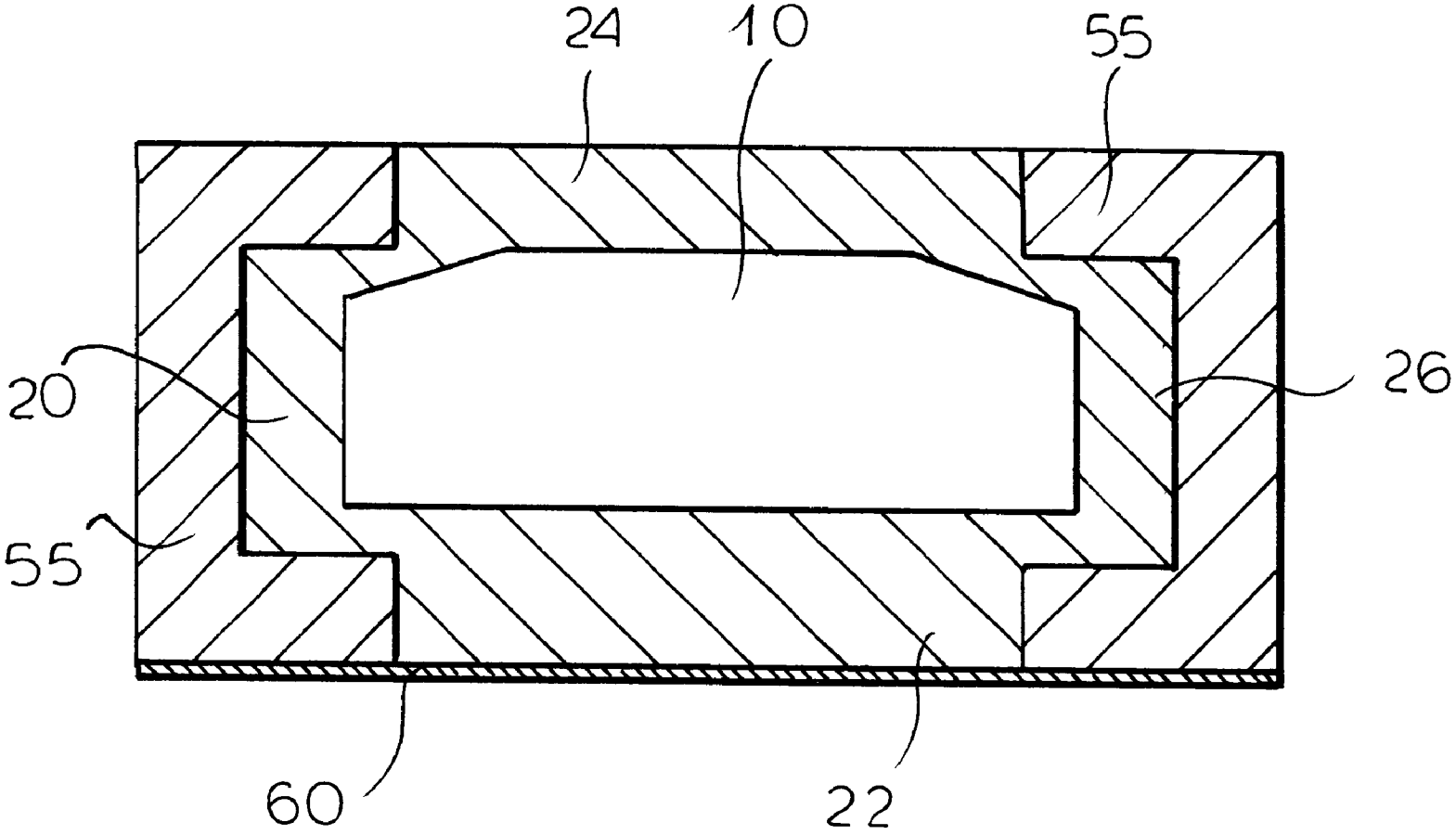

| | |
|---|---|
| FIG. 3 is | a third embodiment of the spacer profile in cross section with a combination of reinforcement elements shapes as wires and as angles; and |
| FIG. 4 is | a fourth embodiment of the spacer profile in cross section with reinforcement elements designed as corner profiles which are fastened outside on the side walls of the spacer profile. |

SPECIFIC DESCRIPTION

FIGS. 1 to 4 show cross-sectional views of the spacer profiles of the invention. Normally this cross section does not change over the entire length of a spacer profile for the respective embodiments, except for tolerances caused by manufacturing.

Figure 1:
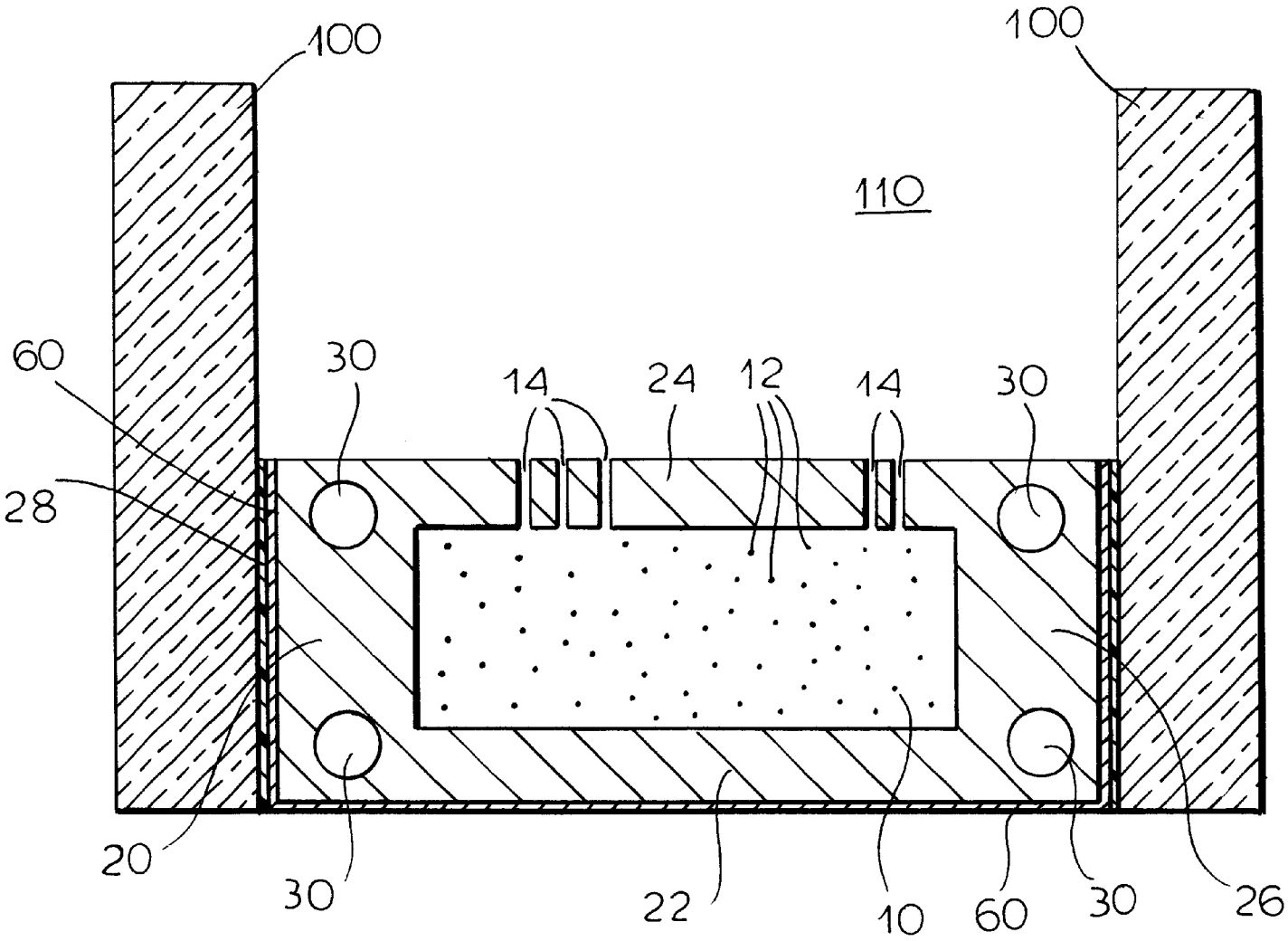
FIG. 1 is | a first embodiment of a spacer profile in cross section with reinforcement elements designed as wires, and showing the panes; |
|

In FIG. 1 a first embodiment of the spacer profile of the invention is shown. The spacer profile is arranged between panes 100, whereby an intermediate pane space 110 is defined, here with a width of approximately 15.5 mm. The profile is fastened to the inside of the panes 100 by means of an adhesive 28. A chamber 10 of the spacer profile with a substantially rectangular cross section has lateral walls 20 and 26, an inner wall 24 facing the intermediate pane space, as well as an outer wall 22 facing the outer edge of the insulating window unit. It is filled at least partially with a hygroscopic material 12, for instance silica gel or a molecular sieve. The hygroscopic material 12 can absorb moisture from the intermediate 110 space through slots or perforations 14 or other water vapor permeable areas in the inner wall 24.

Reinforcement elements in the form of wire 30, extending in the longitudinal direction of the profile, are embedded in each of the four cross-section corner areas of the cross section.

On the lateral walls 20 and 26 and the outer wall 22 of the spacer profile a diffusion-proof layer 60 is applied.

As material for the reinforcement elements here aluminum wire 30 with a diameter of 1.2 mm was used. The two wires embedded each in one lateral wall 20, or 26, are spaced apart so that their midpoints are apart by approximately 4.3 mm. The spacer profile consists of polypropylene, whereby the inner wall 24 and the outer wall 22 each have a thickness of approximately 1 mm, the lateral walls 20, 26 facing the panes each have a thickness of approximately 2.5 mm. The diffusion-proof layer 60 permanently bonded with the outside of the profile consists of tin plate with a thickness of 0.125 mm. Altogether a profile weight of approximately 85 g/m results.

The walls 20 to 26 of chamber 10 of the spacer profile are shown in this Figure as flat surfaces arranged at right angles. It is within the framework of the invention to shape individual walls, particularly the outer wall, with rounded or bevelled areas, or other modified shapes, as is the case in spacer profiles for insulating window units, or to let the walls border each other at angles deviating from 90°.

Figure 2:
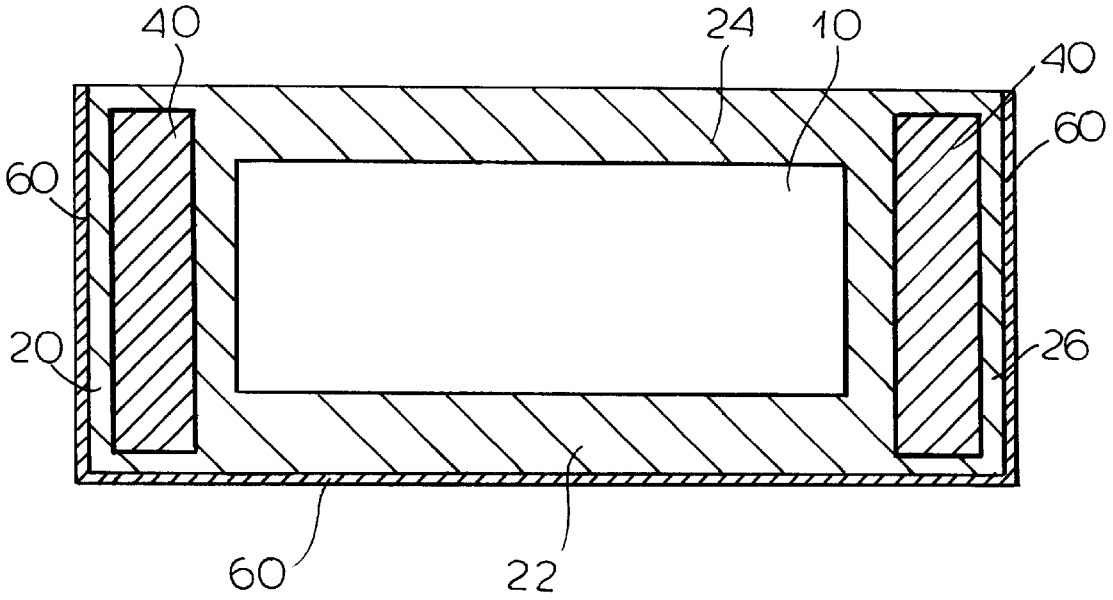
FIG. 2 is | a second embodiment of the spacer profile in cross section with reinforcement elements designed as flat profiles; |

In FIG. 2 a further preferred embodiment is shown, wherein the reinforcement elements are designed as flat profiles 40. The flat profiles 40 are flat aluminum sections with the dimensions of the section 5.5×0.8 $mm^2$. The flat profiles 40 extend substantially over the entire height of the lateral walls 20 and 26 of the spacer profile. As shown in the embodiment of FIG. 1, the spacer profile consists of polypropylene with a wall thickness of 1 mm, respectively 2 mm. The diffusion-proof layer consists of tin plate with a thickness of 0.125 mm, so that generally an approximate profile weight of 97 g/m results.

In FIG. 3 a further embodiment is shown, wherein a combination of wires 30 and corner (angle) profiles 50 are used as reinforcement elements. The wires 30 are again aluminum wires with a diameter of 1.2 mm, while the corner profiles 50 have a thickness of approximately 0.6 mm and a flank length of approximately 2 mm. The corner profiles can also consist of aluminum, just like in the embodiment of FIG. 2, but it is also possible to use other materials for the wires. The corner profiles can consist of a composite material. Further in those areas where the corner profile is bent to fit the outer contour of the spaced-apart panes, it can also consist of other materials or it can have a different thickness than in its other areas where it runs mostly in a straight line. The corner profiles 50 correspond in the shape of their cross section substantially to the shape of the cross section corner areas of the spacer profile. This leads to a particularly high stability of shape. As a diffusion-proof layer 60 here a stainless steel sheet with a thickness of 0.05 mm is used.

In FIG. 4 a further embodiment is shown, wherein the reinforcement elements are designed as corner profiles 55, which are mounted outside on the lateral walls 20, 26 of the spacer profile and so to speak enclose in these areas the spacer profile made of polypropylene or PET. The corner profiles 55 consist of tin plate or aluminum and have a thickness of approximately 0.5 mm. The flank areas of the corner profile projecting into the inner wall 24 and the outer wall 22 of the spacer profile have a length of approximately 2 mm.

The diffusion-proof layer 60 consists of 0.05 mm stainless steel or tin plate. Further a barrier layer of fluorine-containing polymer can be provided as a diffusion-proof layer 60.

In the embodiment example of FIG. 4 the diffusion-proof layer 60 extends over the entire outer wall 22 of the spacer profile, in the embodiment examples of FIGS. 1 and 2 it extends additionally over the entire lateral walls 20, 26, while in the embodiment shown in FIG. 3 no separate diffusion-proof layer is provided.

What is claimed is:

1. A spacer profile adapted to be received between panes, bent to form a one-piece frame surrounding a space formed between said frame and adapted to maintain said space, said spacer profile being of rectangular cross section and composed of an elastically-plastically deformable material with low heat conductivity said spacer profile having an outer peripheral wall perpendicular to said panes, an inner peripheral wall perpendicular to said panes and lateral walls extending parallel to said panes and adjoining said peripheral walls at corner areas and defining a chamber extending along the profile, and a plurality of a plastically deformable reinforcement elements extending in a longitudinal direction of the profile, the reinforcement elements being provided only in the lateral walls and in the corner areas of the profile or only in the corner areas of the profile so that said inner and outer walls are free from said reinforcement elements except in said corner areas.

2. The spacer profile according to claim 1 wherein the chamber is entirely or partially filled with a hygroscopic material and the chamber has vapor permeable areas open towards the space.

3. The spacer profile according to claim 2 wherein the reinforcement elements are wires.

4. The spacer profile according to claim 3 wherein the diameter of the wires is less than 3 mm.

5. The spacer profile defined in claim 1 wherein the diameter is less than 1 mm.

6. The spacer profile according to claim 5 wherein the reinforcement elements include flat profiles or angle profiles.

7. The spacer profile according to claim 6 wherein the flat profiles or angle profiles have a thickness of less than 3 mm.

8. The spacer profile according to claim 6 wherein the reinforcement elements consist of aluminum or an aluminum alloy.

9. The spacer profile according to claim 1 wherein said thickness is less than 1 mm.

10. The spacer profile according to claim 8 wherein the reinforcement elements consist of metal or a metal alloy.

11. The spacer profile according to claim 1 wherein angle profiles used as reinforcement elements substantially correspond in their cross section with a shape of the cross section corner areas of the spacer profile or themselves form these cross section corner areas.

12. The spacer profile according to claim 1 wherein the reinforcement elements extend substantially over entire heights of the lateral walls of the spacer profile.

13. The spacer profile according to claim 2 which consists of a thermoplastic material with a heat conductivity value of $\lambda<0.3$ W/m·K).

14. The spacer profile defined in claim 1 which is composed of polypropylene, polyethylene terephthalate, polyamide or polycarbonate.

15. The spacer profile according to claim 4, further comprising a diffusion-proof layer consisting of a material with a heat conductivity value $\lambda<50$ W/m·K), which extends substantially over the entire width and length of the spacer profile.

16. The spacer profile according to claim 15 wherein the diffusion-proof layer is arranged on the outside of the chamber.

* * * * *